US009415396B2

(12) United States Patent
Ahmadi et al.

(10) Patent No.: US 9,415,396 B2
(45) Date of Patent: Aug. 16, 2016

(54) REFRIGERATION DEVICE

(75) Inventors: Lhassan Ahmadi, Nürnberg (DE); Eugen Gaplikow, Günzburg (DE); Jose Manuel Lamuela Rosano, Giengen (DE); Gerald Schmidt, Gerstetten (DE)

(73) Assignee: BSH Hausgeraete GmbH, Munich (DE)

( * ) Notice: Subject to any disclaimer, the term of this patent is extended or adjusted under 35 U.S.C. 154(b) by 428 days.

(21) Appl. No.: 13/816,506

(22) PCT Filed: Aug. 5, 2011

(86) PCT No.: PCT/EP2011/063521

§ 371 (c)(1), (2), (4) Date: Mar. 5, 2013

(87) PCT Pub. No.: WO2012/022632

PCT Pub. Date: Feb. 23, 2012

(65) Prior Publication Data

US 2013/0214070 A1 Aug. 22, 2013

(30) Foreign Application Priority Data

Aug. 19, 2010 (DE) ..... 10 2010 039 499

(51) Int. Cl.

| | |
|---|---|
| ***B02C 23/20*** | (2006.01) |
| ***B02C 23/00*** | (2006.01) |
| ***F25C 5/04*** | (2006.01) |
| ***F25D 23/12*** | (2006.01) |

(52) U.S. Cl.

CPC ..... *B02C 23/00* (2013.01); *F25C 5/046* (2013.01); *F25D 23/12* (2013.01)

(58) Field of Classification Search

CPC ..... F25C 5/046; F25D 23/00; B02C 23/00
USPC ..... 241/DIG. 17, 36, 65; 62/320, 389, 241
See application file for complete search history.

(56) References Cited

U.S. PATENT DOCUMENTS

| | | | | |
|---|---|---|---|---|
| 5,148,996 | A | 9/1992 | Fletcher et al. | |
| 7,802,444 | B2 * | 9/2010 | Landers et al. | 62/320 |
| 2007/0193299 | A1 | 8/2007 | Landers et al. | |

OTHER PUBLICATIONS

International Search Report PCT/EP2011/063521 dated Nov. 23, 2011.

* cited by examiner

*Primary Examiner* — Mark Rosenbaum
(74) *Attorney, Agent, or Firm* — Laurence A. Greenberg; Werner H. Stemer; Ralph E. Locher

(57) ABSTRACT

A refrigeration device includes an actuating element, and an ice crusher which is activated by the actuating element and configured to crush ice for a period of time during which the actuating element is actuated. The ice crusher is configured to release the crushed ice after actuation of the actuating element has concluded or after a preselectable period of time has elapsed.

19 Claims, 2 Drawing Sheets

REFRIGERATION DEVICE

BACKGROUND OF THE INVENTION

The present invention relates to the field of refrigeration devices.

In order to provide ice, refrigeration devices having automatic ice cube makers can be used, which are equipped with dispensing units for whole ice cubes and broken or crushed ice. Such types of refrigeration devices basically first produce ice cubes which are then dispensed or which are crushed further and then dispensed. In addition, such refrigeration devices can also have a refrigerator compartment for storing and cooling chilled goods.

A fineness grade of the broken ice is predefined in the case of the known devices. The ice cubes are normally pressed against blades for crushing purposes, where the fineness of the crushed ice depends on the spacing of the blades from one another, which spacing can no longer be changed after completion of the device. The fineness of the crushed ice can be varied only from device to device by installing the blades at different spacings from one another. In the ice cube maker gravity causes the crushed ice to fall through the blades into a dispensing unit of the refrigeration device. There the crushed ice of a fixed fineness grade can be immediately removed, for example in a container for drinks. Furthermore, such types of ice cube makers can have a flap beneath the blades in order to prevent crushed ice and ice flakes from accidentally falling into the dispensing unit due to gravity. The ice is then held for at least a short period of time in the region of the blades, with the result that the ice is crushed to differing degrees. The finished crushed ice then has some uncontrollable fineness grade.

The publication WO 207/028029 describes an ice crusher which is arranged on an ice dispenser or a combined ice/drinks dispensing unit. The crushed ice flows from an output of the ice crusher by way of an ice chute into a cup or container.

The publication U.S. Pat. No. 5,148,996 describes an ice crusher in combination with an ice machine. The ice crusher includes a deflection plate. When ice strikes the deflection plate, a circuit for operating the ice crusher is activated by way of an actuator arm and a microswitch.

BRIEF SUMMARY OF THE INVENTION

The object of the present invention is to create a refrigeration device which enables the production of crushed or broken ice in a simple manner.

This object is achieved by the features of the independent claims. Advantageous forms of development are set down in the dependent claims.

In accordance with a first aspect, the invention relates to a refrigeration device having an ice crusher for crushing ice and having an actuating element for activating the ice crusher. The ice crusher is designed so as to crush the ice for the period of time during which the actuating element is actuated. In other words, the ice continues to be crushed for as long as the actuating element is actuated. A degree of crushing thus depends on the period of time the actuating element is actuated. A refrigeration device is understood in particular to be a domestic refrigeration device, in other words a refrigeration device which is used for housekeeping in domestic situations or possibly also in the catering sector, and in particular is used for storing foodstuffs and/or drinks in common household quantities at certain temperatures, such as for example a refrigerator, a freezer or a combined refrigerator/freezer.

The longer the actuating element is actuated, the longer is the period of time during which the ice is crushed and the finer the ice is crushed. A user of the refrigeration device can therefore produce ice of differing grades of fineness simply by actuating the actuating element for differing lengths of time. This makes it possible in a particularly simple manner to produce crushed or broken ice, in particular having almost any fineness grade. The fineness grade relates to an average particle size of the crushed ice. Furthermore, in the case of a refrigeration device which has a flap for preventing the accidental release of crushed ice this can be implemented without the provision of additional components.

According to an embodiment, the ice crusher is designed so as to crush the ice only for the period of time during which the actuating element is actuated. This serves to ensure that the user has control over the fineness of the broken ice.

According to an embodiment, the ice crusher is designed so as to crush the ice while the actuating element is actuated for a preselectable period of time. This makes it possible in a particularly simple manner to produce ice having a certain fineness grade because if the ice is crushed for a fixed preselected period of time the ice always has the same or almost the same fineness grade.

According to an embodiment, the refrigeration device has a setting element for setting the preselectable period of time. This makes it possible in a simple manner to set the preselectable period of time. The setting element can for example consist of a switch, a knob, a pushbutton, a rotary switch, a screen or a touch-sensitive screen.

According to an embodiment, the setting element is provided so as to choose a first preselectable period of time in a first position and to choose a second preselectable period of time in a second position. In other words, a preselected period of time is chosen depending on the position of the setting element. This makes it possible in a simple manner to set the preselectable period of time. The preselected period of time can for example be determined empirically and/or be stored on a storage medium of a control unit of the refrigeration device.

According to an embodiment, the first position corresponds to a first fineness grade and the second position corresponds to a second fineness grade. This helps to ensure that a certain fineness grade can be chosen in a simple manner.

According to an embodiment, an average particle size of the ice is greater in the case of the first fineness grade than in the case of the second fineness grade. This helps to ensure in a simple manner that ice can be chosen having differing fineness grades and differing average particle sizes.

According to an embodiment, a fineness grade of the crushed ice depends on the period of time during which the actuating element is actuated. It is therefore simple to produce broken ice having differing fineness grades. If the actuating element is for example actuated for a short time, then coarsely crushed ice will for example be produced. If the actuating element is actuated for a longer period of time, a more finely crushed ice will however be produced.

According to an embodiment, the refrigeration device releases the crushed ice, in particular automatically, after actuation of the actuating element has concluded or after the preselectable period of time has elapsed. This can help to ensure that the crushed ice exhibits the fineness desired by a user of the refrigeration device.

According to an embodiment, the ice crusher has a flap for releasing the crushed ice. This enables the crushed ice to be dispensed in a simple manner. Furthermore, the flap prevents premature dispensing of inadequately crushed ice and/or prevents ice flakes from falling out.

According to an embodiment, the ice crusher is designed so as to release the crushed ice, in particular automatically, after actuation of the actuating element has concluded or after a preselectable period of time has elapsed, which can be the aforementioned period of time, and after a predefined after-running time has elapsed. This helps to ensure that the crushed ice is dispensed in its entirety.

According to an embodiment, the ice crusher has a plurality of blades which crush the ice during the period of time. This makes it possible in a simple manner to crush the ice.

According to an embodiment, the refrigeration device has a release element which when actuated releases the broken ice. This makes it possible to have the ice crushed and to subsequently have it dispensed.

According to a second aspect, the invention relates to a method for crushing ice by means of the ice crusher which is activated by actuating the actuating element. The ice is crushed by means of the ice crusher for the period of time during which the actuating element is actuated. This makes it possible by actuating the actuating element for the certain period of time to have the ice crushed during the period of time and thereby to produce crushed ice of the certain fineness grade.

According to an embodiment, the ice is crushed only for the period of time during which the actuating element is actuated. This can help to precisely predefine the fineness grade of the ice.

According to an embodiment, the ice is crushed while the actuating element is actuated for the preselectable period of time. This can help to prevent the ice from being crushed more finely than desired. Furthermore, this can help to ensure that the crushed ice has exactly the desired fineness grade.

According to an embodiment, the preselectable period of time is set by means of the setting element. This can help to enable the preselectable period of time to be set in a simple manner and/or precisely.

According to an embodiment, the first preselectable period of time is chosen in the first position of the setting element and the second preselectable period of time is chosen in the second position of the setting element. This makes it possible in a simple manner to preselect differing periods of time.

According to an embodiment, the first fineness grade is chosen by setting the setting element in the first position and the second fineness grade is chosen by setting the setting element in the second position. This makes it possible in a simple manner to choose or preselect differing fineness grades and thereby differing periods of time.

According to an embodiment, crushed ice having the first average particle size is produced in the case of the first fineness grade and in the case of the second fineness grade crushed ice is produced having the second average particle size which is smaller than the first average particle size. This makes it possible in a simple manner to produce crushed ice of differing average particle sizes.

According to an embodiment, the crushed ice is dispensed after actuation of the actuating element has concluded or after the preselectable period of time has elapsed. This can help to ensure that the crushed ice exhibits the desired fineness.

According to an embodiment, the crushed ice is dispensed after actuation of the actuating element has concluded or after a preselectable period of time has elapsed, which can be the aforementioned period of time, and after the predefined after-running time has elapsed. This helps to ensure that the crushed ice is dispensed in its entirety.

According to an embodiment, the broken ice is released when the release element is actuated. This makes it possible firstly to crush the ice and subsequently dispense it.

BRIEF DESCRIPTION OF THE DRAWINGS

Further exemplary embodiments will be described with reference to the attached drawings. In the drawings.

DETAILED DESCRIPTION OF EXEMPLARY EMBODIMENTS OF THE PRESENT INVENTION

Figure 1:
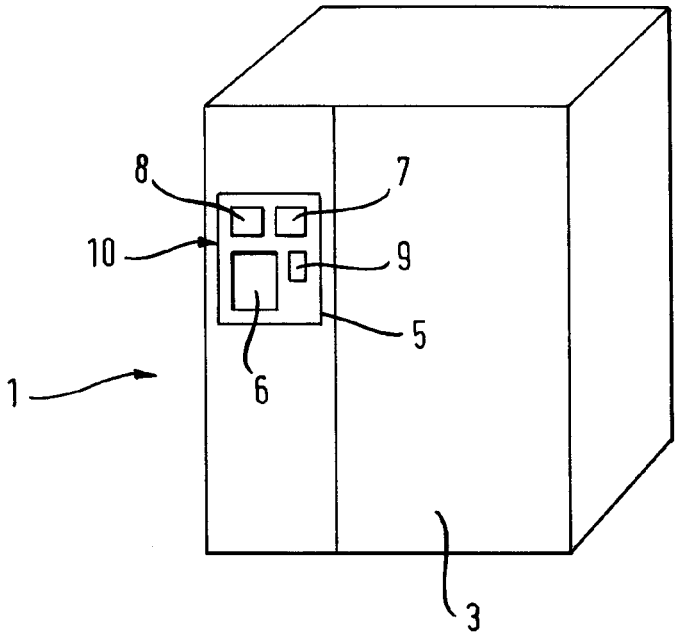
FIG. 1 shows a refrigeration device.

Elements having the same construction or function are identified by the same reference characters in all the figures.

FIG. 1 shows a refrigeration device 1 which for example is a refrigerator and/or freezer and is suitable for storing and cooling chilled goods. For storage of the chilled goods the refrigeration device 1 has an interior space (not shown) which is accessible by way of a door 3.

In addition to the storage of chilled goods, the refrigeration device 1 is suitable for producing ice cubes and crushed ice, which is also referred to as broken ice. In order to produce the ice cubes and the crushed ice the refrigeration device 1 has an ice machine 10. The ice machine 10 has an operating panel 5. The operating panel 5 comprises an output chute 6, an actuating element 7, a setting element 8 and a release element 9. The output chute 6 can also be referred to as the dispensing unit and can have an ice chute and/or a cover (not shown).

Figure 2:
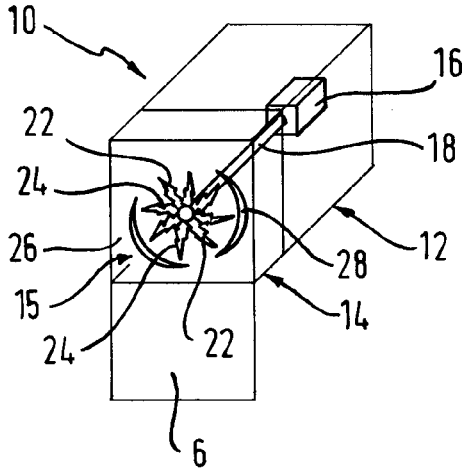
FIG. 2 shows an ice machine.

FIG. 2 shows the ice machine 10. The ice machine 10 preferably comprises an ice cube machine 12 for producing ice cubes and an ice crusher 14 for crushing the ice cubes and for producing the crushed ice. As an alternative to the ice cube machine 12, a different device for producing ice can also be provided, in particular one which produces ice not in cube form. A drive 16 drives a shaft 18 which conveys the ice cubes from the ice cube machine 12 to the ice crusher 14 and drives blades 22, 24.

The ice crusher 14 has a chamber 15 into which the ice cubes are conveyed and in which first blades 22, second blades 24, a flap 26 and a brake 28 are arranged. Furthermore, additional blades 22, 24 can also be provided, for example five blades 22, 24. With the aid of the brake 28 the first blades 22 can be detected while the second blades 24 rotate, which means that the ice cubes are crushed and broken by means of the blades 22, 24. For example, two first blades 22 and three second blades 24 can be provided. The crushed ice can be removed from the chamber 15 by opening the flap 26, fall into the output chute 6 and thereby be released. The flap 26 and the brake 28 can for example each be actuated with the aid of a controllable solenoid actuator.

With the aid of the setting element 8 it is possible to choose a fineness grade which the crushed ice is to have. The fineness grade is representative of an average particle size of the crushed ice. With the aid of the actuating element 8 the drive 16 is activated, the first blades 22 are detected and the second blades 24 are driven. The ice in the chamber 15 is crushed by this means. The ice is crushed during a period of time when the actuating element 7 is actuated. A preselectable period of time during which the ice is to be crushed can be set with the aid of the setting element 8. With the aid of the release element 9 the flap 26 can be opened, with the result that the crushed ice is released.

Figure 3:
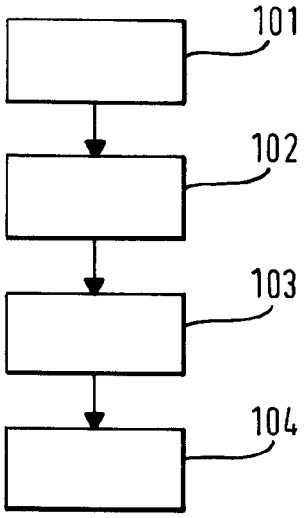
FIG. 3 shows a diagram of a first method for crushing ice.

FIG. 3 shows a diagram of a method for producing the crushed ice, in particular with the aid of the refrigeration device 1, wherein steps 101 to 104 can be executed sequentially.

In step 101, the actuating element 7 is actuated.

In step 102, the ice in the chamber 15 is crushed as a consequence of actuating the actuating element 7.

In step 103, a check is made as to whether the actuating element 7 is still being actuated and if applicable the crushing process is continued.

Step 104 is executed as soon as actuation of the actuating element 7 has concluded and the actuating element 7 is thus no longer being actuated. In step 104, the flap 26 is opened and the crushed ice in the chamber 15 is released.

The ice is thus crushed for a period of time which corresponds to the period of time during which the actuating element is actuated 7. Furthermore, both periods of time can for example run concurrently, which means that the ice is being crushed at the same moment in which the actuating element 7 is also being actuated. The longer the actuating element 7 is actuated, the longer will the ice be crushed. The longer the ice is crushed, the finer will the crushed ice be. Depending on the period of time during which the actuating element 7 is actuated, it is thus possible to set a fineness grade which the crushed ice is to have.

Alternatively or additionally, the fineness grade can be set by choosing a fineness grade which can be preselected with the aid of the setting element 8. The preselectable fineness grade corresponds to a preselectable period of time during which the ice is to be crushed. In other words, the period of time for which the ice is to be crushed is chosen at least indirectly by way of the setting element 8. To this end, the setting element 8 can be placed in different positions. For example, in a first position of the setting element 8 the ice is crushed for a first period of time and in a second position for a second period of time. Furthermore, the setting element 8 can have further setting options. The positions are for example representative of the fineness grades "coarse", "fine" or "very fine".

Figure 4:
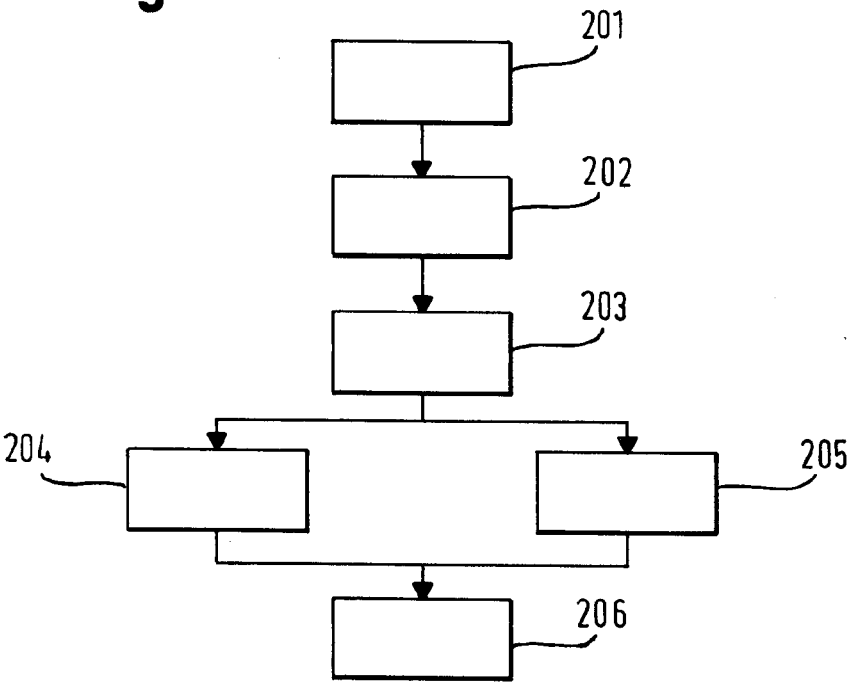
FIG. 4 shows a diagram of a second method for crushing ice.

A diagram of a corresponding method having a preselected fineness grade is shown in FIG. 4 with reference to the steps 201 to 206 which can be executed sequentially.

In step 201, one of the preselectable fineness grades is set with the aid of the setting element 8, by means of which a preselectable period of time for crushing the ice is automatically chosen.

In a step 202, depending on the fineness grade set, a period of time for which the ice is to be crushed is determined. The period of time can be assigned to the fineness grade for example by way of an assignment rule which is stored on a storage medium of the refrigeration device 1. Depending on the fineness grade set, the period of time can thus be determined in a simple manner.

In a step 203, the ice is crushed.

In a step 204, a check is made as to whether the actuating element 7 is still being actuated. If the actuating element 7 is no longer being actuated, then step 206 is executed. Otherwise, the ice is crushed further.

Parallel to step 204, a check is made in step 205 as to whether the period of time corresponding to the preselected fineness grade, which is also referred to as preselected period of time, has elapsed. If this period of time has elapsed, then step 206 is executed. Otherwise, step 204 is executed repeatedly and the ice is crushed further.

In step 206, the flap 26 is opened and the crushed ice is released. The flap 26 is opened in particular automatically after the preselected period of time has elapsed. Furthermore, the flap 26 can also be opened automatically after actuation of the actuating element 7 has concluded. Alternatively, the flap 26 can be opened with the aid of the release element 9 after actuation of the actuating element 7 has concluded. Alternatively, the flap 26 can be opened while the actuating element 7 is actuated, when it is then possible to dispense ice of differing fineness grades because both the ice which has already been crushed for an extended time and also whole or almost whole ice cubes fall through the flap 26 into the dispensing unit 6.

Step 204 thus constitutes a check for a pure termination condition for the crushing of the ice. As soon as the actuating element 7 is no longer being actuated, then the crushing of ice is terminated in step 204. The period of time during which ice crushing takes place therefore depends directly on the period of time for which the actuating element 7 is actuated.

By contrast, after the preselected period of time has elapsed, in step 205 the flap 26 can be opened and the ice crushed up to that point can be released but the crushing process can be continued with new ice cubes as long as the actuating element 7 is being actuated. Furthermore, at any desired point in time the flap 26 can be opened with the aid of the release element 9 and the ice crushed up to that point can be released. Step 205 does not therefore need to be a pure termination condition for the crushing of the ice.

Alternatively or additionally, after actuation of the actuating element 7 has concluded and/or after the preselected period of time has elapsed the ice can continue to be crushed for a predefined, preferably short, after-running time because this can help to remove all the crushed ice from the chamber 15.

Additionally, a minimum period of time can be stipulated for crushing the ice, which serves to ensure that the ice cubes are at least partially crushed when crushed ice is requested. Furthermore, it is also possible to stipulate a maximum period of time for crushing the ice, which is intended to prevent the ice crusher 14 or the drive 16 from overheating. The minimum or the maximum period of time can be stored on the storage medium of the refrigeration device 1 and automatically checked.

The invention claimed is:

1. A refrigeration device, comprising:

an actuating element; and an ice crusher activated by the actuating element;

a setting element for setting a preselectable period of time, the setting element being positionable into a first position corresponding to a first fineness grade and into a second position corresponding to a second fineness grade of crushed ice;

based on a user's decision, the ice crusher is operated in one of two ways, in a first way the ice crusher is configured to crush ice for a period of time during which the actuating element is actuated and to release the crushed ice after actuation of the actuating element has concluded, and in a second way the ice crusher is configured to crush ice while the actuating element is actuated for a period of time which is given by the preselectable period of time set by the setting element and to release the crushed ice after the preselectable period of time has elapsed.

2. The refrigeration device of claim 1, wherein the first fineness grade in the first position of the setting element is defined by an average particle size of crushed ice which is greater than an average particle size of the second fineness grade in the second position of the setting element.

3. The refrigeration device of claim 1, wherein the period of time during which the actuating element is actuated is determinative for selection of a fineness grade of crushed ice.

4. The refrigeration device of claim 1, wherein the ice crusher has a flap for releasing crushed ice.

5. The refrigeration device of claim 1, wherein the ice crusher is configured to release crushed ice in either of three ways, a first way after actuation of the actuating element has concluded, a second way after the preselectable period of time has elapsed, a third way after a predefined after-running time has elapsed.

6. The refrigeration device of claim 1, wherein the ice crusher has at least one blade for crushing ice during the period of time.

7. The refrigeration device of claim 1, further comprising a release element which when actuated releases crushed ice.

8. The refrigeration device of claim 1, wherein the refrigeration device is suitable for storing and cooling chilled goods.

9. The refrigeration device of claim 1, further comprising an interior space for storage of the chilled goods being accessible by way of a door.

10. The refrigeration device of claim 1, further comprising an operating panel having a release element.

11. The refrigeration device of claim 10, wherein with the aid of the release element a flap is opened, with the result that the crushed ice is released.

12. The refrigeration device of claim 10, wherein at any desired point in time a flap is opened with the aid of the release element and the ice crushed up to that point is released.

13. The refrigeration device of claim 1, further comprising a storage medium on which an assignment rule is stored with which the period of time is assigned to the fineness grade.

14. The refrigeration device of claim 1, wherein a minimum period of time is stipulated for crushing the ice, which serves to ensure that ice cubes are at least partially crushed when crushed ice is requested.

15. The refrigeration device of claim 1, wherein a maximum period of time is stipulated for crushing the ice, which is intended to prevent the ice crusher or a drive from overheating.

16. The refrigeration device of claim 1, wherein the setting element is selected from the group consisting of a switch, a knob, a pushbutton, a rotary switch, a screen or a touch-sensitive screen.

17. The refrigeration device of claim 1, further comprising an operating panel including the actuating element.

18. The refrigeration device of claim 1, further comprising an operating panel including the setting element.

19. The refrigeration device of claim 1, further comprising a storage medium having a minimum or a maximum period of time stored thereon.

* * * * *